US006145142A

United States Patent [19]

Rechin et al.

[11] Patent Number: 6,145,142

[45] **Date of Patent: *Nov. 14, 2000**

[54] APPARATUS AND METHOD FOR CONTROLLING A PATIENT POSITIONED UPON A CUSHION

[75] Inventors: Michael Rechin, Silver Creek, N.Y.; John K. Whitney, deceased, late of Dorado Estates, Puerto Rico, by Marilyn Whitney, executor

[73] Assignee: Gaymar Industries, Inc., Orchard Park, N.Y.

[ * ] Notice: This patent is subject to a terminal disclaimer.

[21] Appl. No.: 09/340,423

[22] Filed: Jun. 28, 1999

Related U.S. Application Data

[63] Continuation of application No. 09/096,122, Jun. 11, 1998, Pat. No. 5,926,883.

[60] Provisional application No. 60/055,569, Aug. 13, 1997.

[51] Int. Cl.[7] ..... A47C 27/10; A47C 27/08

[52] U.S. Cl. ..... 5/706; 5/710; 5/713; 5/905; 5/655.3; 362/276; 362/318

[58] Field of Search ..... 5/713, 905, 706, 5/710, 654, 655.3; 362/96, 276, 318, 802; 250/341.1

[56] References Cited

U.S. PATENT DOCUMENTS

| | | | |
|---|---|---|---|
| 772,034 | 10/1904 | Fulton | 265/63 |
| 3,217,818 | 11/1965 | Engelsher et al. | 177/144 |
| 3,338,323 | 8/1967 | Swersey et al. | 177/144 |
| 3,360,062 | 12/1967 | Potter | 177/144 |
| 3,656,478 | 4/1972 | Swersey | 128/214 E |
| 3,746,835 | 7/1973 | Yu et al. | 5/422 |
| 4,002,216 | 1/1977 | Solow | 177/208 |
| 4,038,973 | 8/1977 | Moore | 128/1 B |
| 4,220,984 | 9/1980 | Truher et al. | 362/130 |
| 4,542,547 | 9/1985 | Sato | 5/453 |
| 4,742,437 | 5/1988 | Downey | 5/666 |
| 4,825,868 | 5/1989 | Susa et al. | 128/376 |
| 4,873,737 | 10/1989 | Savenije | 5/453 |
| 4,934,002 | 6/1990 | Watanabe | 5/453 |
| 4,947,500 | 8/1990 | Seiler | 5/453 |
| 4,991,244 | 2/1991 | Walker | 5/400 |
| 5,092,415 | 3/1992 | Asano | 177/208 |
| 5,152,021 | 10/1992 | Vrzalik | 5/455 |
| 5,216,768 | 6/1993 | Bodine et al. | 5/453 |
| 5,234,065 | 8/1993 | Schmidt | 177/209 |
| 5,487,196 | 1/1996 | Wilkinson et al. | 5/453 |
| 5,542,136 | 8/1996 | Tappel | 5/710 |
| 5,586,346 | 12/1996 | Stacy et al. | 5/710 |
| 5,634,225 | 6/1997 | Miller et al. | 5/710 |
| 5,781,949 | 7/1998 | Weismiller et al. | 5/715 |
| 5,794,289 | 8/1998 | Wortman et al. | 5/713 |
| 5,901,391 | 5/1999 | Kato | 5/666 |
| 5,926,883 | 7/1999 | Rechin et al. | 5/706 |

FOREIGN PATENT DOCUMENTS

0663169A1 12/1994 European Pat. Off. .

OTHER PUBLICATIONS

Communication–European Search Report–Dec. 15, 1999, Reference No. 98/08245 EP –Gaymar Industries Inc., Application No. 98114744.0–2310, Abstract.

*Primary Examiner*—Brian K. Green
*Assistant Examiner*—Rodrigo J. Morales
*Attorney, Agent, or Firm*—Hodgson, Russ, Andrews, Woods & Goodyear LLP

[57] ABSTRACT

The present invention details a pressurizable mattress. The mattress has at least one inflatable cushion having a pair of sides, and at least one set of an electromagnetic energy emitting device and an electromagnetic energy receiving device. The electromagnetic energy emitting device, when operating, illuminates the interior of the inflatable cushion. The electromagnetic energy receiving device collects the illuminating energy. The operation of the mattress requires a means for measuring the optical aperture of the inflatable cushion. The measuring means determines the optical aperture of the inflatable cushion by measuring the quantity of illuminating energy collected by the electromagnetic energy receiving device when the electromagnetic energy emitting device illuminates the interior of the inflatable cushion.

43 Claims, 4 Drawing Sheets

APPARATUS AND METHOD FOR CONTROLLING A PATIENT POSITIONED UPON A CUSHION

The present invention is a continuation of U.S. Pat. application Ser. No. 09/096,122, filed on Jun. 11, 1998, now U.S. Pat. No. 5,926,883, which relies on the filing date of U.S. provisional application No. 60/055,569, filed Aug. 13, 1997.

FIELD OF THE INVENTION

The present invention relates to a method and apparatus for monitoring and/or controlling therapeutic beds and mattress systems and the patients supported thereon. More particularly, the invention relates to devices for sensing and monitoring the position of a patient lying upon a cushion and for controlling the inflation volume.

BACKGROUND OF THE INVENTION

Inflatable therapeutic supports for bedridden patients have been well known for many years. Such therapeutic supports include inflatable mattresses and cushions.

Most therapeutic mattresses are designed to reduce "interface pressures", which are the pressures encountered between the mattress and the skin of a patient lying on the mattress. It is well known that interface pressures can significantly affect the well-being of immobile patients in that higher interface pressures can reduce local blood circulation, tending to cause bed sores and other complications. With inflatable mattresses, such interface pressures depend (in part) on the air pressure within the inflatable support cushions.

Rotating the patient on an inflatable mattress is also a well known method to avoid bed sores on immobile patients. Such a method is disclosed in U.S. Pat. No. 5,794,289 which is commonly assigned and is hereby incorporated by reference.

U.S. Pat. No. 5,794,289 describes a mattress unit having a plurality of air cells. The mattress unit rotates a patient by controlling the air pressure in each air cell by inflation and deflation. To rotate a patient to its right side requires deflating the right air cells and inflating the left air cells. The air pressure required to rotate the patient depends on the patient's weight, body type and various other parameters.

The quantity of air pressure that rotates one patient, i.e., 30 degrees may rotate another patient, i.e., 5 degrees. For example, two female patients weigh 130 pounds, one patient is pear-shaped and the other is apple-shaped. The pear-shaped patient rotates 15 degrees with 10 mm Hg while an apple-shaped patient rotates 7 degrees with 10 mm Hg. Obviously each patient is unique and different. Therefore, the programming that controls the air pressure in each mattress unit must be altered to comply with each patient.

Programming an air pressure mattress unit requires a skilled technician. The skilled technician analyzes each patient and alters the programming to attain the desired rotation and air pressure. One means to avoid the expensive technician's analysis and re-programming is to create a self-monitoring mattress.

Previous self-monitoring air pressure mattresses have utilized electrical signal transmission devices and electrical signal receiving devices that sandwich the top and bottom of each bladder to monitor the bladder size. The bladder size corresponds to the desired rotation and air pressure. Such signal devices are disclosed in U.S. Pat. No. 5,794,289.

Those signal devices generate electrical signals, like rf signals, that may adversely effect other medical equipment. Thus, there is a need to have a self-monitoring air volume mattress that monitors the bladder size to determine when the desired rotation and loft of the mattress is attained for any patient type without causing any possible adverse effect on other medical equipment.

It is another object of the present invention to make the mattress easy to use for an untrained user.

"Bottoming" refers to any state where the upper surface of any given cushion is depressed to a point that it contacts the lower surface, thereby markedly increasing the interface pressure where the two surfaces contact each other.

There has also been a long-felt need to have an inflatable mattress which maintains a desired air volume within the inflated cushion or cushions to prevent bottoming.

SUMMARY OF THE INVENTION

The present invention details a pressurizable mattress. The mattress has at least one inflatable cushion having a pair of sides, and at least one set of an electromagnetic energy emitting device and an electromagnetic energy receiving device. The electromagnetic energy emitting device, when operating, illuminates the interior of the inflatable cushion, the electromagnetic energy receiving device collects the illuminating energy. The operation of the mattress requires a means for measuring the optical aperture of the inflatable cushion. The measuring means determines the optical aperture of the inflatable cushion by measuring the quantity of illuminating energy collected by the electromagnetic energy receiving device when the electromagnetic energy emitting device illuminates the interior of the inflatable cushion. Thereby, air pressure is an independent variable of the present invention.

The above and other objects, features, and advantages of the present invention will be apparent in the following detailed description of the preferred embodiments thereof taken in conjunction with the accompanying drawings wherein the same reference numerals denote the same or similar parts throughout the several views.

DETAILED DESCRIPTION OF THE INVENTION

Figure 1:
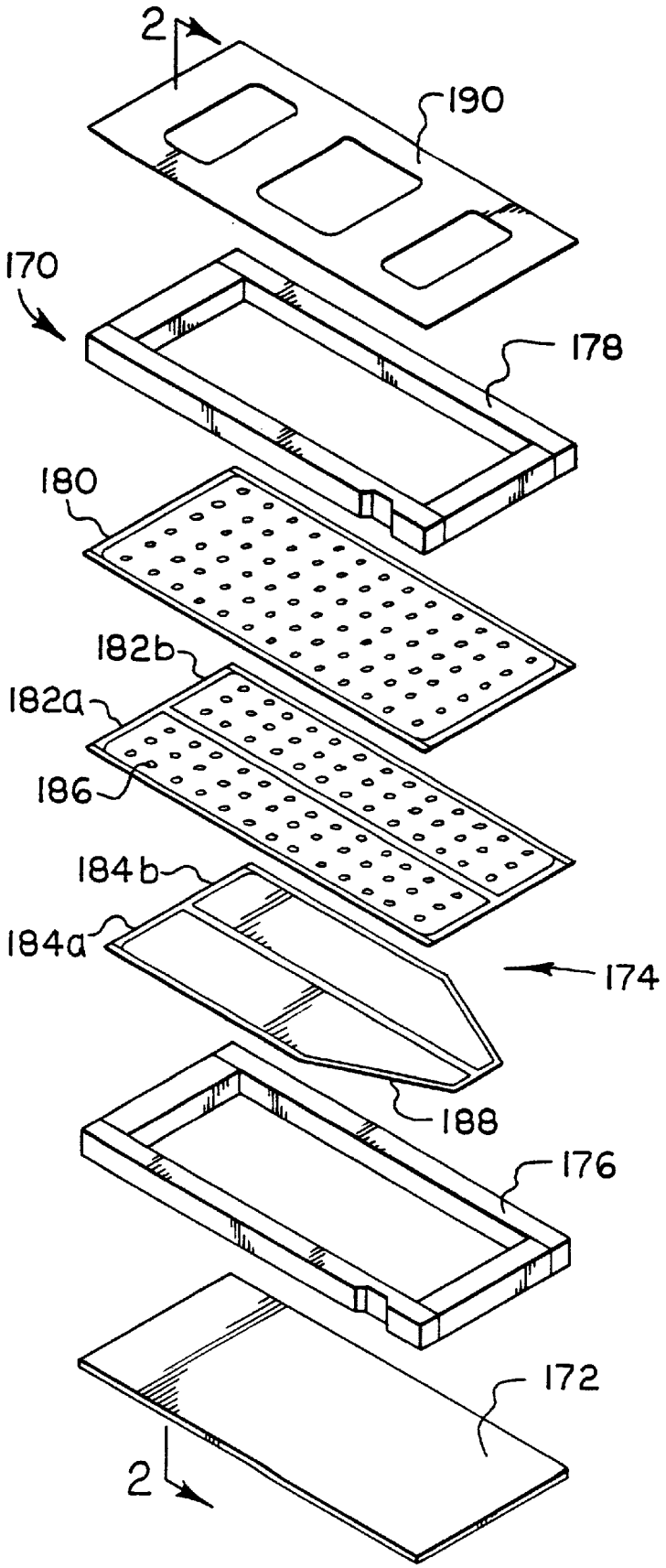
FIG. 1 is a view illustrating a mattress contain 9 cushions within a crib.
Figure 2:
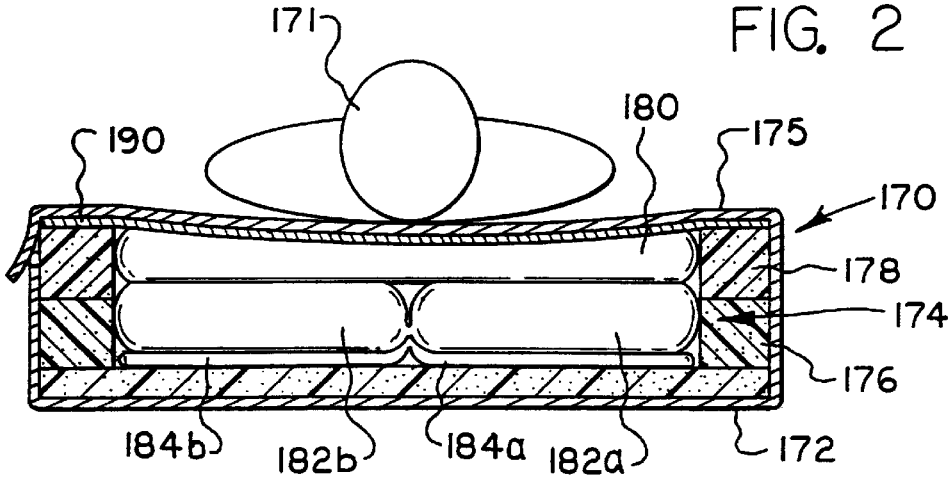
FIG. 2 is a sectional view of the mattress of FIG. 1 taken along the lines 2—2 thereof and illustrating the cushion in an untilted condition.
Figure 3:
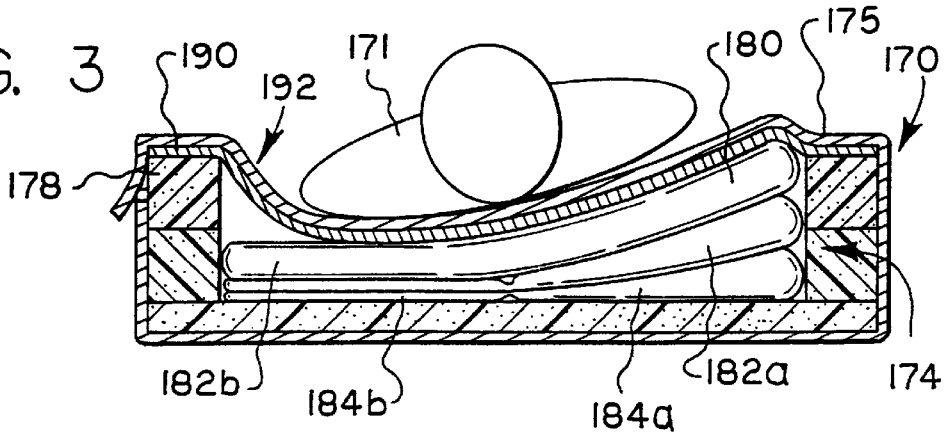
FIG. 3 is a view similar to that of FIG. 2 of the mattress and illustrating the cushion tilted to one side.
Figure 4:
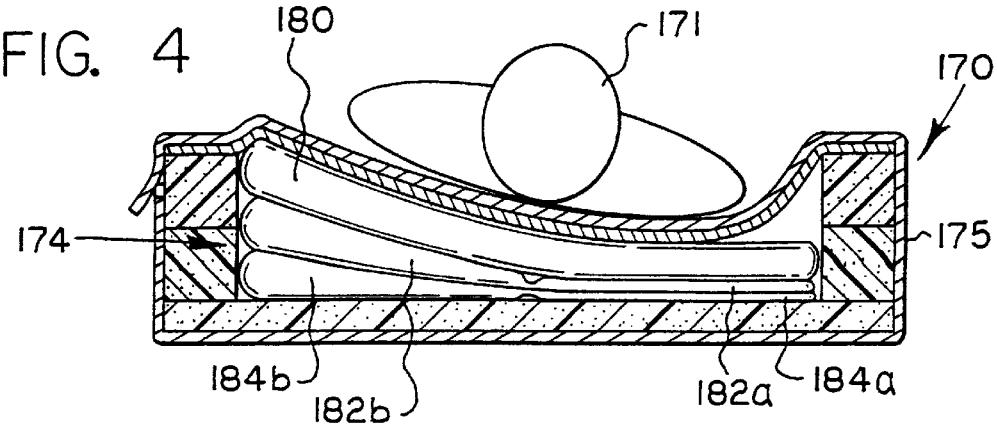
FIG. 4 is a view similar to that of FIG. 3 of the mattress and illustrating the cushion tilted to the other side.

Referring to FIGS. 1 and 2, there is illustrated generally at 170 a mattress containing an inflatable cushion 180 which is tiltable to one side, as illustrated in FIGS. 3 and 4, for the purpose of rolling a patient, illustrated at 171, over, placing the patient in a better position for lifting from the mattress, or otherwise moving the patient as needed.

The mattress 170 includes a foam support member 172 on which rests a tilting assembly, illustrated generally at 174, which will be described hereinafter, the tilting assembly 174 disposed generally within and circumscribed about its periphery by a lower crib 176. The crib 176 in turn supports an upper crib 178, in which is contained the inflatable air cell or cushion 180 which may be any other suitable inflatable cushion. The cushion 180 may be any suitable inflatable bladders and have button welds, illustrated at 186, uniformly spaced thereover to prevent ballooning thereof when pressurized.

The tilting assembly 174 comprises two sets of bladders, each set of bladders includes an upper and a lower inflatable bladder 182 and 184 respectively the width of each of which being slightly less than half of the width of cushion 180. The bladders 182, 184 are further divided into right bladders 182*a*, 184*a* and left bladders 182*b*, 184*b*. The foot end portions 188 of the lower bladders 184 are tapered over about one-third of the length thereof to allow relatively greater lifting capacity for the head end and central portions supporting the torso of a patient since the torso requires greater lifting capacity than the feet. The upper bladder 182 may be any suitable inflatable bladders and have button welds, illustrated at 186, uniformly spaced thereover to prevent ballooning thereof when pressurized. As seen in FIG. 1, each lower bladder 184 is absent button welds or the like so that it may desirably balloon when pressurized to lift the corresponding side of the cushion 180 as needed. Otherwise, bladders 182, 184 may include inflation means (not shown).

A fabric strip 190 bridges across and is adhesively or otherwise suitably attached to the upper surface of crib 178 for lateral stability. The cribs 176 and 178 and support member 172 are adhesively or otherwise suitably attached, and the assembly including the tilting assembly 174 and cushion 180 are enclosed within a zippered mattress cover 175 as shown in FIG. 2.

FIG. 2 illustrates the mattress 170 with the cushion 180 in a level condition for the patient 171 to lie normally thereon. In this condition, the cushion 180 and upper bladder 182 are fully inflated while the lower bladder 184 is uninflated.

FIG. 3 illustrates tilting of the cushion 180 to about a 15 degree angle to one side by deflating the left side bladder 182*b* and by inflating the right side bladder 184*a*. As seen in FIG. 3, this lowers the left side of the cushion 180 and raises the right side thereof thereby providing a "trough," illustrated at 192, on the left side to prevent the patient 171 from falling off the mattress. The patient 171 is thus "caught" by the upper crib 178 with the fabric strip 190 providing lateral stability to prevent the crib 178 from bowing outwardly.

FIG. 4 illustrates tilting of the cushion 180 from the position of FIG. 2 to about a 15 degree angle to the other side by deflating the right side upper bladder 182*a* and by inflating the left side lower bladder 184*b*. This lowers the right side of the cushion 180 and raises the left side thereof thereby providing a "trough" 192 on the right side to prevent the patient from falling off the mattress. The fabric strip 190 again provides lateral stability to prevent the crib from bowing outwardly.

The cushion 180 may of course be tilted to a higher angle than 15 degrees. For example, the cushion 180 may be tilted to an angle of perhaps about 45 degrees by further inflation of the corresponding lower bladder 184, allowing ballooning thereof so that it approaches a tubular shape, and the width of the fabric strip 190 is selected to suitably accommodate the degree of tilt.

In accordance with the present invention, the mattress 170 has at least one set of an electromagnetic emitting device 194 and an electromagnetic receiving device 196. The receiving device 196 is any light receiver, i.e., infrared light to frequency converter by Texas Instruments, Dallas, Tex., Model No. TSL245. Likewise, the emitting device 194 is any light emitting diode (LED) device, preferably emitting electromagnetic energy such as infrared light.

Each device of the set 194, 196 is relatively on opposite sides of the mattress 170 and securely attach to the respective portion of the mattress 170. The opposite sides of the mattress, for example, are as follows (See FIG. 5):

LED device 194*a* is on the right and head loft zone 802 of the foam support member 172 and receiver 196*a* is on the right and foot loft zone 808 of the upper crib 178;

LED device 194*a* is on the right side head area of the lower crib 176 and the receiver 196*b* is on the left side head loft zone 802 of the foam support member 172;

LED device 194*c* is on the left side torso area of the upper crib 178 and the receiver 196*c* is on the right side torso loft zone 804 of the upper crib 178;

LED device 194*d* is on the left side leg area of the lower crib 176 and the receiver 196*d* is on the right side leg loft zone 806 of the lower crib 176;

LED device 194*e* is on the left side foot area of the foam support member 172 and the receiver 196*e* is on the right side foot loft zone 808 of the foam support member 172; and/or LED device 194*f* is on the left and foot loft zone 808 of the upper crib 178 and receiver 196*f* is on the left and head loft zone 802 of the upper crib 178.

As described, the LED device 194 and the receiver 196 can be anywhere in relation to each other so long as each device of the set 194, 196 operates as intended.

The LED device 194 illuminates the whole entire interior of the bladders 180, 182, 184. The light from the LED device 194 essentially disperses within the bladders 180, 182, 184 because each bladder 180, 182, 184 is a diffuse, translucent material, i.e., 70/30 blend of polyurethane and polyvinylchloride. The bladder 180, 182, 184 can also be colored. When the bladder 180, 182, 184 is colored, the bladder is effectively translucent to the electromagnetic energy emitted from the electromagnetic energy emitting device 194.

The receiver 196 collects the light and converts the light into an electrical signal 970, 980, such as a frequency signal. The receiver 196 transmits the electrical signal to a central processing unit (CPU) 900 as shown in FIG. 6.

Figure 6:
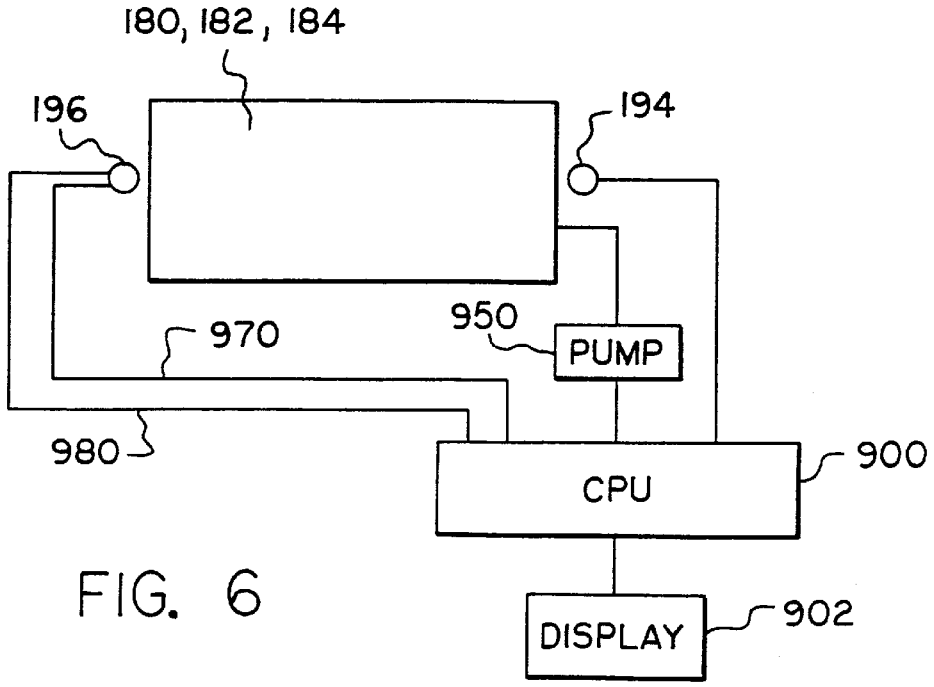
FIG. 6 is a schematic view of the interconnections of the mattress of FIG. 1.

Referring to FIG. 6, the CPU 900 converts the electrical signal into a value that indicates the quantity of light collected by the receiver 196 ("light value"). The CPU 900 can be any conventional unit capable of being programmed to receive signals from the receiver 196, convert the signals as described above, control a pump 950 that inflates and deflates the bladders 180, 182, 184, and generate signals to operate at least one set of devices, the LED device 194 and the receiver 196. The operation of the pump and its interconnections with the various bladders 180, 182, 184 are disclosed in U.S. Pat. No. 5,794,289, which is commonly assigned and incorporated by reference.

Figure 7:
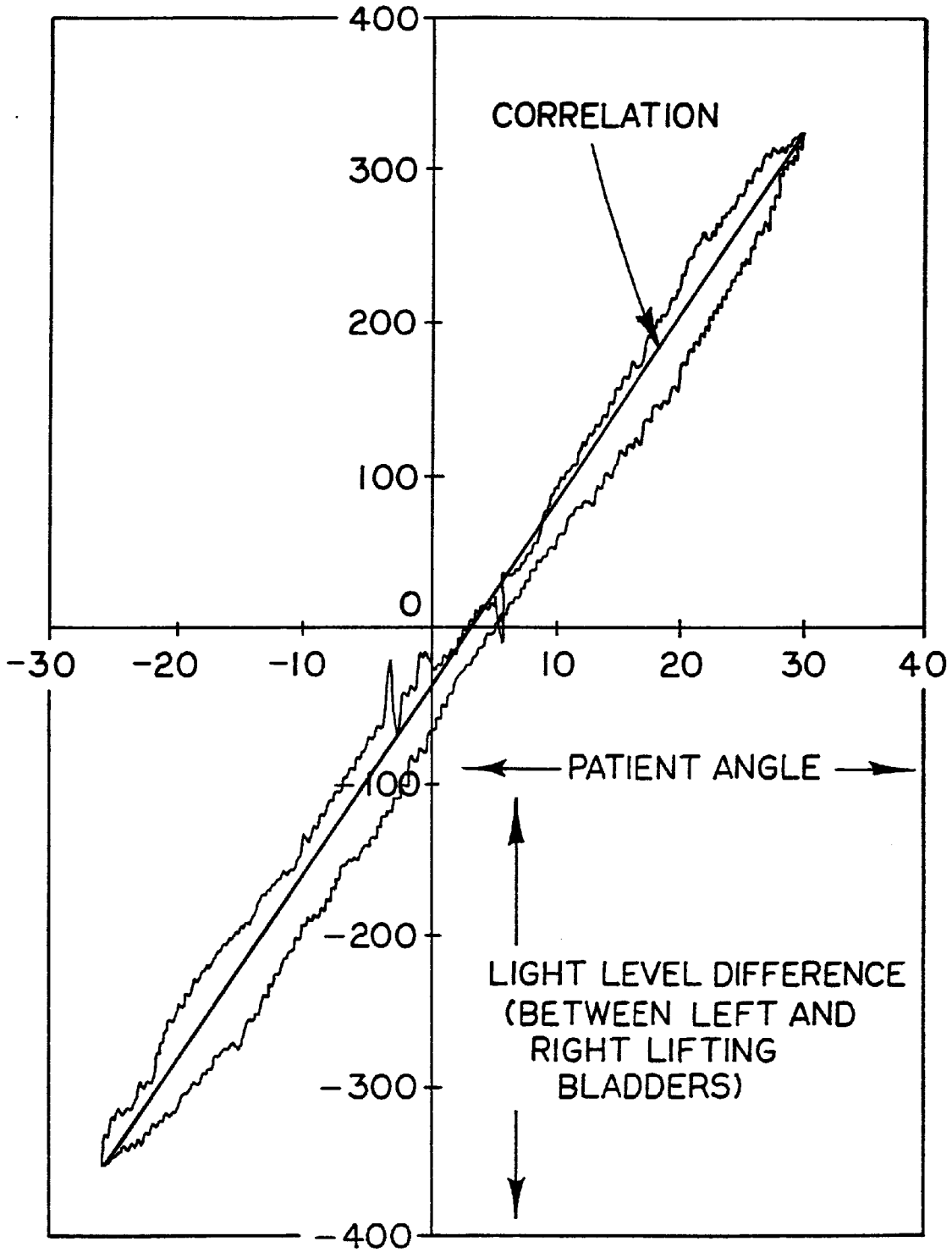
FIG. 7 is a graph of the tilting angle of the mattress to the measurement of electromagnetic energy.

A display module 902 interconnects to the CPU 900 and outputs the light value. The display 902 can also output the angle of the patient. Such outputs can be printed in a graph so an untrained technician can monitor, and illustrate to superiors, if the patient is being properly rotated. An example of one such display is shown in FIG. 7. FIG. 7 shows the light value is directly proportional to the angle of the patient. This direct correlation occurs because the quantity of light from the LED device 194 that the receiver 196 collects depends on the optical aperture of the bladder 180, 182, 184 and the optical aperture relates to the angle of the mattress and inherently the angle of the patient 171.

In another embodiment of the present invention, the CPU 900 compares the light values between left and right sides of the bladders 180, 182, 184. The optical aperture of the left bladders 182*b*, 184b in relation to the optical aperture of the right bladders 182*a*, 184*a* determines the angle of the mattress 170 when any patient, i.e., of different weight and body type, lies on the mattress 170 as shown in (and described above for) FIGS. 2, 3, and 4. For example, in FIG. 2 the left bladders 182*b*, 184*b* and the right bladder 182*a*, 184*a* are in a ratio of 1:1 thus the angle of the mattress is zero, in FIG. 3 the ratio is 1:3 and the angle of the mattress is a −10 degrees (the negative value is a relative value indicating the angle direction), and in FIG. 4 the ratio is 4:1 and the angle of the mattress is 15 degrees. Each ratio of the light value represents a predetermined angle of the patient. Thus, the ratio of the light value correlates to the angle of the patient.

Under normal operations, the mattress 170 may be exposed to a reading lamp, sunlight or any other ambient light. This ambient light illuminates the interior of the bladders 182, 184 like the LED device 194. Thus, ambient light could interfere with the measurements of the light value.

Such ambient light does not interfere with the light values in the present invention. In the present invention, the LED device 194 is turned on and off by CPU 900. While the LED device 194 is off, the receiver 196 collects the ambient light and generates an ambient measurement signal 970. The CPU 900 measures the ambient measurement signal into a reference measurement and stores that reference measurement. When the LED device 194 is on, the receiver collects the ambient light and the light from the LED device 194 and generates a collective measurement signal 980. The CPU 900 measures the collective measurement signal 980 into a combined measurement, and subtracts the reference measurement from the combined measurement to attain an accurate light value.

Figure 5:
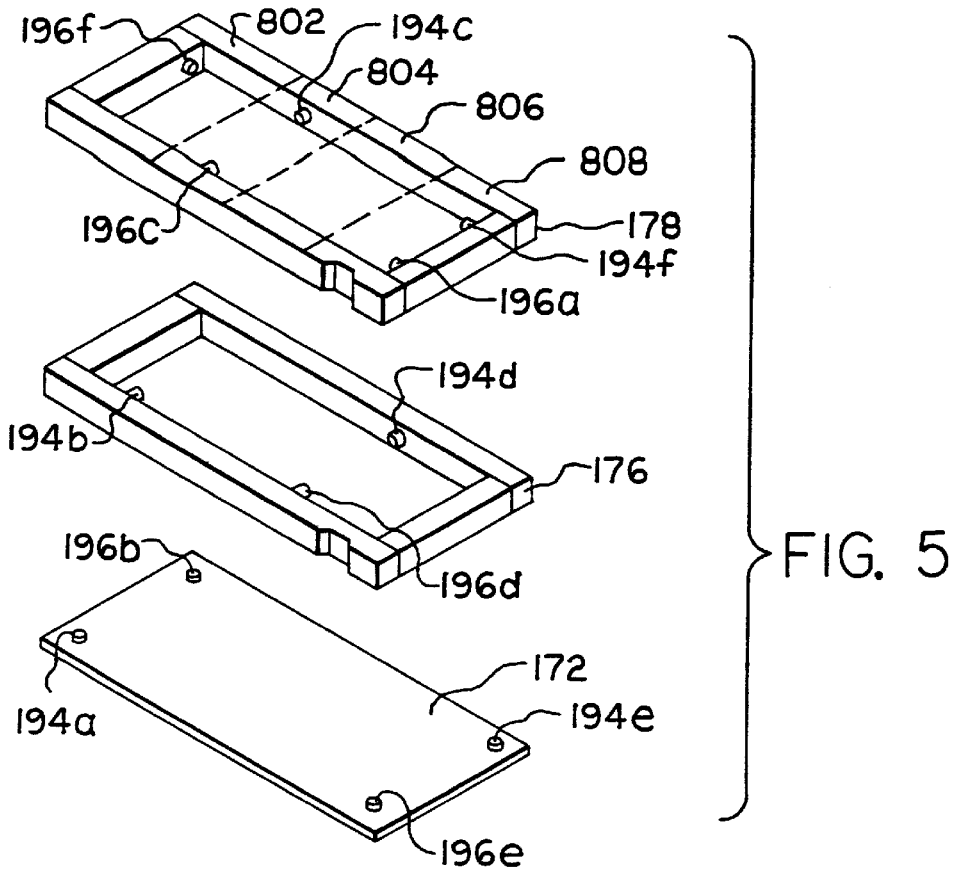
FIG. 5 is a schematic view of the various positions of the sets of electromagnetic emitting devices ad electromagnetic receiving devices in the mattress.

Preferably, the CPU 900 alternates between different sets 194, 196 when the LED device 194 is off. Those sets 194, 196 are located in various positions throughout the mattress, as illustrated in FIG. 5. By changing the sets 194, 196, i.e., every 30 seconds, each set 194, 196 records a different light value. The average of these different light values ensures the desired patient angle is obtained. If the desired angle is not obtained, the CPU 900 operates the pump 950 to inflate and/or deflate the various bladders 180, 182, 184 to obtain the desired optical aperture.

The present invention, as indicated, is controlled by the CPU 900. The CPU 900 has the display monitor 902. An unskilled technician receives orders, i.e., from a doctor requiring the patient be rotated every 30 minutes at 25 degrees. The technician turns on the CPU 900 and display monitor 902. The CPU 900 has a program that makes the unskilled technician enter all the relevant information, such as angle of patient and for how long. After entering the relevant information, the CPU 900 rotates the patient, operates the pump to inflate and deflate the bladders 180, 182, 184, and generates an output, like a graph, that reveals all the relevant data about when the patient was rotated, what angle and for how long. Hence, the unskilled technician does not evaluate the patient's weight or body type to properly operate the mattress 170 or have to control the air pressure of the mattress 170.

Another embodiment of the present invention is that the LED device 194 and the receiver 196 can be substituted with a fiber optic cable device. This fiber optic cable device is, i.e., a Light Conduit™, which is manufactured by Lumitex in Strongville, Ohio. Such a device emits light from its distal end when light traverses from the CPU 900 through the cable to the distal end. Conversely, another fiber optic cable device collects light from the mattress unit 170 and transmits that light from the distal end through the cable to the CPU 900. This fiber optic cable eliminates any electrical wires from entering the mattress unit 170. Thereby, diminishing the possibility of an electrical short and an electrical fire in the mattress unit 170.

In another embodiment of the present invention, the present invention can determine if the mattress 170 provides sufficient volume, i.e., loft to prevent bottoming, to the patient. If the light value is too low, it indicates the loft in each bladder is too low. This light value, therefore, indicates whether insufficient air volume is within the mattress 170.

It was found that opaque or clear materials for bladders 180, 182, 184 were not as effective for transmitting light as diffuse, translucent material. When the bladders 180, 182, 184 are clear or opaque the light value remains constant. Thus, determining the rotation or loft of the mattress 170 as set forth in the present invention is difficult with clear or opaque bladders 180, 182, 184.

Other embodiments of the present invention, in particular the mattresses, are illustrated and described in U.S. Pat. No. 5,794,289 which is commonly assigned and hereby incorporated by reference herein. One such embodiment, in that patent, has bladders for each particular zone of a patient.

Obviously, with a plurality of sensors 194, 196 and bladders for each patient zone the mattress unit 170 controls the loft and/or rotation of each zone, i.e., foot 808, leg 806, torso 804 and head 802. As such, the torso zone 804 can be at a different loft and/or angle than, i.e., the foot zone 808.

The air volume in the optical aperture of the bladders 180, 182, 184 is greatest when the patient is off the mattress 170. As such, the CPU 900 records when the optical aperture suddenly increases. Such an increase in optical aperture indicates the patient is off the mattress.

Mattress 170 is normally programmed for a particular patient. The mattress 170 generates and records the air volume to raise and rotate the patient. If the quantity of air volume necessary to raise and/or turn a patient differs from previous days, then the change in air volume indicates a change in weight to the patient. Such a change in air volume is recorded and reported as a change in weight of the patient.

It is intended that the above description of the preferred embodiments of the structure of the present invention and the description of its operation are but one or two enabling best mode embodiments for implementing the invention. Other modifications and variations are likely to be conceived of by those skilled in the art upon a reading of the preferred embodiments and a consideration of the appended claims and drawings. These modifications and variations still fall within the breadth and scope of the disclosure of the present invention.

We claim:

1. A pressurizable mattress comprising at least one inflatable cushion having an interior chamber, the interior chamber has a perimeter defined by a top portion, a bottom portion, and a pair of sides of the inflatable cushion;

at least one set of an electromagnetic energy emitting device and an electromagnetic energy receiving device, wherein the electromagnetic energy emitting device emits illuminating energy that illuminates the interior chamber, and the electromagnetic energy receiving device collects the illuminating energy.

2. The pressurizable mattress of claim 1 wherein the inflatable cushion is a translucent material.

3. The pressurizable mattress of claim 1 wherein the electromagnetic energy emitting device is selected from a group consisting of a light emitting diode and a light emitting fiber optic cable.

4. The pressurizable mattress of claim 1 wherein the electromagnetic energy receiving device is selected from a group consisting of a light detector and a light receiving fiber optic cable.

5. The pressurizable mattress of claim 1 further comprising an inflatable bladder for tilting the inflatable cushion to at least one predetermined angle.

6. The pressurizable mattress of claim 1 further comprising a means for measuring an optical aperture of the interior chamber by measuring the illuminating energy collected by the electromagnetic energy receiving device when the electromagnetic energy emitting device illuminates the interior chamber, and determines the angle of the inflatable cushion.

7. The pressurizable mattress of claim 5 wherein the inflatable bladder is positioned beneath at least one side portion of said cushion for raising said one side portion.

8. The pressurizable mattress of claim 1 wherein the illuminating energy is infrared light.

9. The pressurizable mattress of claim 1 wherein the electromagnetic energy emitting device and the electromagnetic energy receiving device are opposite to each other in the mattress.

10. The pressurizable mattress of claim 1 further comprising a pump for altering pressure in the inflatable cushion depending on the optical aperture.

11. The pressurizable mattress of claim 1 further comprising a cover that receives the electromagnetic energy receiving device, the electromagnetic energy emitting device, and the inflatable cushion.

12. The pressurizable mattress of claim 1 wherein the inflatable cushion is a colored translucent material reflecting the electromagnetic energy emitted by the electromagnetic energy emitting device.

13. A pressurizable mattress comprising at least one inflatable cushion having a first interior chamber, the first interior chamber has a perimeter defined by a top portion, a bottom portion, and a pair of sides of the inflatable cushion;

an inflatable bladder for tilting the inflatable cushion to at least one predetermined angle, the inflatable bladder has a second interior chamber, the second interior chamber has a perimeter defined by a top portion, a bottom portion, and a pair of sides of the inflatable bladder;

wherein said inflatable bladder and inflatable cushion are translucent materials;

at least one set of an electromagnetic energy emitting device and an electromagnetic energy receiving device, wherein the electromagnetic energy emitting device emits illuminating energy that illuminates the first interior chamber and second interior chamber, the electromagnetic energy receiving device collects the illuminating energy.

14. The pressurizable mattress of claim 13 wherein the light emitting device is selected from a group consisting of a light emitting diode and a light emitting fiber optic cable.

15. The pressurizable mattress of claim 13 wherein the light receiving device is selected from a group consisting of a light detector and a light receiving fiber optic cable.

16. The pressurizable mattress of claim 13 wherein the inflatable bladder is positioned beneath at least one side portion of said cushion for raising at least one of said side portions.

17. The pressurizable mattress of claim 13 wherein the illuminating energy is infrared.

18. The pressurizable mattress of claim 13 wherein the light emitting device and the light receiving device are opposite to each other in the mattress.

19. The pressurizable mattress of claim 13 further comprising a pump for altering pressure in the inflatable cushion depending on the optical aperture.

20. The pressurizable mattress of claim 13 further comprising a cover that receives the electromagnetic energy receiving device, the electromagnetic energy emitting device, and the inflatable cushion.

21. The pressurizable mattress of claim 13 wherein the inflatable cushion is a colored translucent material reflecting the electromagnetic energy emitted by the electromagnetic energy emitting device.

22. A method to measure an optical aperture of a first inflatable bladder in a pressurizable mattress comprising the steps of:

providing the first inflatable bladder having an interior chamber, which is translucent, and is used for supporting a patient thereupon, the interior chamber is defined by the perimeter of a top surface, a bottom surface and a pair of sides of the inflatable bladder;

providing an electromagnetic energy emitting device for transmitting electromagnetic energy through the interior chamber;

providing an electromagnetic energy receiving device for receiving the electromagnetic energy;

illuminating the interior chamber with the electromagnetic energy such that the electromagnetic energy deflects from the top surface and the bottom surface under the weight of a patient that decreases the electromagnetic energy collected by the electromagnetic energy receiving device.

23. The method of claim 22 wherein the first inflatable bladder is a translucent material.

24. The method of claim 22 further comprising the step of providing a second inflatable bladder for tilting the first inflatable bladder to at least one predetermined angle.

25. The method of claim 22 further comprising the step of determining an optical aperture of the first inflatable bladder by measuring the electromagnetic energy received and determines the angle of the first inflatable bladder.

26. The method of claim 24 wherein the second inflatable bladder is positioned beneath at least one side portion of said first inflatable bladder for raising at least one of said side portions.

27. The method of claim 22 comprising the step of positioning the electromagnetic emitting device and the electromagnetic receiving device opposite to each other in the pressurizable mattress.

28. The method of claim 22 further comprising the step of altering the pressure in first inflatable bladder depending on the optical aperture.

29. The method of claim 22 further comprising the step of inflating the first inflatable bladder.

30. The method of claim 22 further comprising the step of generating an output of the first inflatable bladder.

31. The method of claim 26 further comprising the step of determining an angle of the first inflatable bladder and the second inflatable bladder by measuring an optical aperture of the second inflatable bladder and the optical aperture of the first inflatable bladder.

32. The method of claim 31 further comprising the step of altering the pressure in first inflatable bladder depending on the determination of the angle of the second bladder and the first inflatable bladder.

33. A pressurizable mattress comprising at least one inflatable cushion having an interior chamber, the interior chamber has a perimeter defined by a top portion, a bottom portion, and a pair of sides of the inflatable cushion;

at least one set of an electromagnetic energy emitting device and an electromagnetic energy receiving device, wherein the electromagnetic energy emitting device emits illuminating energy that illuminates the interior chamber, and the electromagnetic energy receiving device collects the illuminating energy; and a pump for inflating the inflatable cushion when the measuring means reaches a pre-determined measurement.

34. The mattress of claim 33 wherein the predetermined measurement is just before the top portion of the inflatable cushion contacts the bottom portion of the inflatable cushion.

35. The mattress of claim 33 further comprising a cover that receives the electromagnetic energy receiving device, the electromagnetic energy emitting device, and the inflatable cushion.

36. The mattress of claim 33 further comprising a means for measuring an optical aperture of the interior chamber by measuring the illuminating energy collected by the electromagnetic energy receiving device when the electromagnetic energy emitting device illuminates the interior chamber; said measuring means determines when a patient is off the pressurizable mattress.

37. The mattress of claim 36 where in said measuring means determines a change of weight in a patient.

38. The mattress of claim 5 wherein said measuring means determines when a patient is off the mattress.

39. The mattress of claim 5 wherein said measuring means determines a change of weight in a patient.

40. The mattress of claim 13 further comprising a means for measuring an optical aperture of the first interior chamber by measuring the illuminating energy collected by the electromagnetic energy receiving device when the electromagnetic energy emitting device illuminates the first interior chamber and the second interior chamber and determines when a patient is off the mattress.

41. The mattress of claim 13 further comprising a means for measuring an optical aperture of the first interior chamber by measuring the illuminating energy collected by the electromagnetic energy receiving device when the electromagnetic energy emitting device illuminates the first interior chamber and the second interior chamber and determines a change of weight in a patient.

42. The method of claim 25 wherein the step of measuring determines when a patient is off the mattress.

43. The method of claim 25 wherein the step of measuring determines a change of weight in a patient.

* * * * *